US007748586B2

(12) United States Patent
Akiba

(10) Patent No.: US 7,748,586 B2
(45) Date of Patent: Jul. 6, 2010

(54) DRIVING TOOL

(75) Inventor: Yoshitaka Akiba, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/937,679

(22) Filed: Nov. 9, 2007

(65) Prior Publication Data

US 2008/0121676 A1 May 29, 2008

(30) Foreign Application Priority Data

Nov. 10, 2006 (JP) ..... P2006-305535

(51) Int. Cl.
*B27C 1/08* (2006.01)

(52) U.S. Cl. ..... 227/10; 227/142; 227/147; 227/8; 123/46 SC

(58) Field of Classification Search ..... 227/8, 227/130, 142, 10; 123/46 SC; 411/1, 2, 411/283, 227
See application file for complete search history.

(56) References Cited

U.S. PATENT DOCUMENTS 2,355,253 A * 8/1944 Whitfield ..... 411/283
5,263,626 A * 11/1993 Howard et al. ..... 227/8
5,263,842 A * 11/1993 Fealey ..... 227/8
5,827,027 A * 10/1998 Wakabayashi ..... 411/283
6,196,781 B1 * 3/2001 Yang ..... 411/384
6,886,730 B2 * 5/2005 Fujisawa et al. ..... 227/8
7,055,729 B2 * 6/2006 Taylor et al. ..... 227/142
7,140,524 B2 * 11/2006 Hung et al. ..... 227/8

FOREIGN PATENT DOCUMENTS

| | | |
|---|---|---|
| JP | 2000-190251 | 7/2000 |
| JP | 2000-334678 | 12/2000 |
| JP | 2004-014870 | 1/2004 |
| JP | 2004-351523 | 12/2004 |

* cited by examiner

*Primary Examiner*—Rinaldi I. Rada
*Assistant Examiner*—Nathaniel Chukwurah
(74) *Attorney, Agent, or Firm*—McDermott Will & Emery LLP

(57) ABSTRACT

A driving tool in a form of a combustion type nail driving machine 1 for injecting a nail by combustion gas is provided. The driving tool includes a lower pusher which is arranged at a distal end in a projecting direction of a nose through which the nail passes, formed with an elongated hole, and adapted to come into contact with a wood, an upper pusher which is urged by the lower pusher, and an extending-contracting mechanism interposed between the lower pusher and the upper pusher. The extending-contracting mechanism includes a bush which is in contact with the upper pusher and formed with a threaded hole, and a screwing part which can be screwed into the threaded hole after passing through the elongated hole. The screwing part includes a bolt which connects the lower pusher and the bush, and a lever.

2 Claims, 7 Drawing Sheets

DRIVING TOOL

CROSS-REFERENCE TO RELATED APPLICATIONS

This application is based on and claims the benefit of priority from the prior Japanese Patent Application No. 2006-305535, filed on Nov. 10, 2006; the entire contents of which are incorporated herein by reference.

BACKGROUND

1. Technical Field

The present invention relates to a driving tool.

2. Description of Related Art

In a driving tool for driving a fastening piece such as a nail, driving of the nail or the like has been heretofore controlled by cooperation between a mechanism such as a trigger by which an operator inputs power and a mechanism for detecting that the driving tool is in contact with an object to be worked such as wood (a detecting mechanism).

In this detecting mechanism, a pusher is provided in an injection part in the driving tool from which the fastening piece is injected, as shown in JP-A-2000-334678. After it has been detected that this pusher has come into contact with the object to be worked, driving operation is conducted. By providing this pusher, too deep sinking or too short sinking of the fastening piece when it has been driven is avoided.

SUMMARY

In case where the pusher is always at a constant position with respect to the injection part, too deep sinking or too short sinking of the fastening piece may sometimes occur depending on types of wood. In order to avoid this phenomenon, mechanisms for changing the position of the pusher with respect to the injection part are disclosed as described in the related art.

In the mechanism disclosed in JP-A-2000-190251, an adjusting dial concerned with change of the position of the pusher is fixed by engagement between projected portions and recessed portions. However, they are not always reliably fixed, and so, it has sometimes happened that the adjusting dial is rotated, when it has accidentally struck some other member, and the position of the pusher is changed.

Besides, the mechanisms disclosed in JP-A-2000-334678, JP-A-2004-154870, and JP-A-2004-351523 are so complicated that the driving tools have become heavy in weight, and the number of maintenances has increased, resulting in high cost.

In view of the above, it is an object of the invention to provide a driving tool provided with a pusher whose position can be reliably fixed with a simple structure.

In order to solve the above described problem, there is provided according to the invention, a driving tool including: an injection part defining a passage for a fastening piece; a lower pusher being provided in the injection part so as to swing and to be brought into contact with an object to be worked; and an upper pusher adapted to slide in association with the lower pusher, wherein the driving tool further includes: a fixing part being in contact with the upper pusher and formed with a threaded hole; a threaded part being screwed into the threaded hole thereby to tightly connect the lower pusher to the fixing part; and a grasping part being provided between the threaded part and the fixing part, and capable of being grasped, wherein the threaded part has an engaging part adapted to be engaged with the grasping part, whereby the grasping part is movable between an engaged position in which it can be engaged with the engaging part and a non-engaged position in which it cannot be engaged with the engaging part. According to this structure, the structure of the driving tool can be simplified, and driving depth can be adjusted.

In the driving tool, it would be preferable that the lower pusher has an elongated hole which extends in the injecting direction, the lower pusher is fixed between the threaded part and the fixing part, when the threaded part is screwed into the threaded hole after passing through the elongated hole, and the lower pusher can move in the elongated hole, by rotating the grasping part while it is in the engaged position thereby to release the threaded part from screwed engagement. According to this structure, the structure of the driving tool can be simplified, and driving depth can be adjusted.

Moreover, it would be preferable that a spring for urging the grasping part with respect to the threaded part is interposed between the threaded part and the grasping part, and the grasping part moves to the engaged position against urging force of the spring.

According to this structure, the grasping part is prevented from moving to the engaged position, unless the grasping part is intentionally moved to the engaged position. As the results, it is possible to prevent the screwing part from rotating accidentally.

According to the invention, there is further provided a driving tool comprising a housing, a motive power part provided in the housing, a control part for controlling operation of the motive power part, an actuating part which is actuated by the motive power part to inject a fastening piece to an object to be worked, and an injection part which is provided at an end of the housing in an injecting direction in which the fastening piece is injected, and defines a passage for the fastening piece which is injected by the actuating part, characterized in that the control part includes a lower pusher which is arranged at a distal end of the injection part in the injecting direction, and adapted to come into contact with the object to be worked, an upper pusher which is urged by the lower pusher, and an extending-contracting mechanism which is interposed between the lower pusher and the upper pusher, the lower pusher is formed with an elongated hole extending in the injecting direction, the extending-contracting mechanism includes a bush formed with a threaded hole and adapted to be brought into contact with the upper pusher, and a screwing part which can be screwed into the threaded hole after passing through the elongated hole, the screwing part includes a threaded part which is screwed into the threaded hole thereby to tightly connect the lower pusher to the bush, and a grasping part which can be grasped, the threaded part has an engaging part which can be engaged with the grasping part, and the grasping part is so constructed as to be movable between an engaged position in which it can be engaged with the engaging part, and a non-engaged position in which it cannot be engaged with the engaging part.

According to this structure, the structure of the control part for controlling the motive power part can be simplified. Moreover, by rotating the screwing part, it becomes possible to restrict the position of the lower pusher, but the screwing part can be rotated only when the grasping part is in the engaged position. As the results, by usually arranging the grasping part in the non-engaged position, it is possible to make the screwing part non-rotatable, and hence, the screwing part can be prevented from rotating accidentally.

According to the invention, there is further provided a driving tool including: an injection part which defines a passage for a fastening piece, a lower pusher being slidably provided in the injection part and adapted to come into contact with an object to be worked, and an upper pusher which slides in association with the lower pusher, wherein the driving tool further includes: a fixing part which is arranged in contact with the upper pusher; a threaded part for tightly connecting the lower pusher to the fixing part; and a grasping part being provided between the threaded part and the fixing part and capable of being grasped, wherein the threaded part has an engaging part which can be engaged with the grasping part, and wherein the grasping part is movable between an engaged position in which it can be engaged with the engaging part and a non-engaged position in which it cannot be engaged with the engaging part. According to this structure, it is possible to easily adjust the position of the lower pusher, only by rotating the grasping part.

According to the driving tool of the invention, it is possible to provide the driving tool provided with the pusher whose position can be reliably fixed with the simple structure.

DESCRIPTION OF THE EMBODIMENTS

Figure 1:
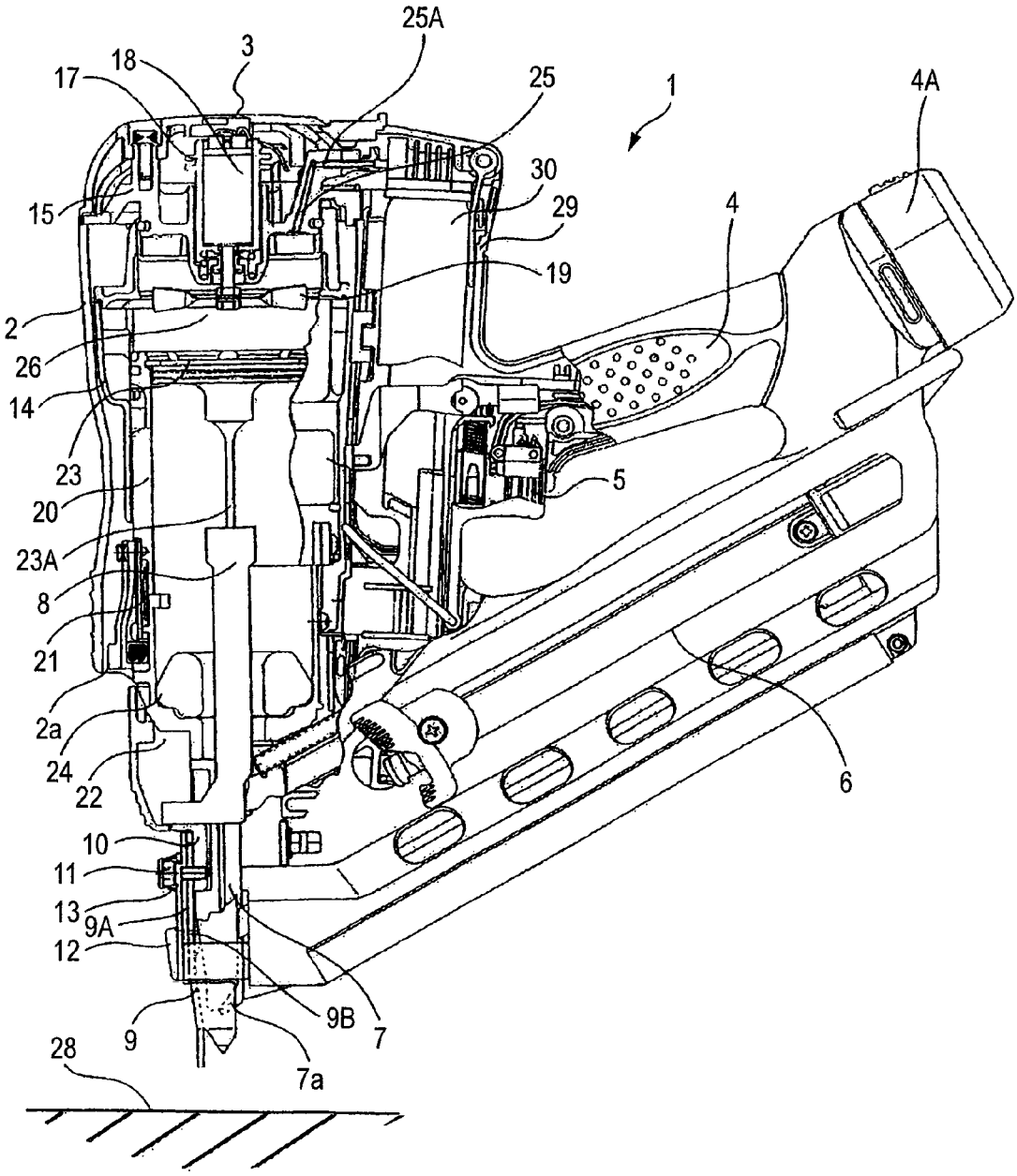
FIG. 1 is a sectional side view of a driving tool in an embodiment according to the invention.

Referring to FIGS. 1 to 6, a driving tool in an embodiment according to the invention will be described. A combustion type nail driving machine 1 as shown in FIG. 1 is a driving tool in which explosive power of combustible gas is used as motive power, and a nail is used as a fastening piece. The combustion type nail driving machine 1 includes a housing 2 as an outer shell, and a head cover 3 which is formed with a suction port (not shown) is attached to an upper part of the housing 2. A handle 4 is extended from a side part of the housing 2. The handle 4 is provided with a trigger switch 5, and a battery 4A is detachably inserted into the handle 4. The trigger switch 5 cooperates with a head switch (not shown) which will be described below, so that the nail can be injected only when both of the switches are turned on.

A bomb chamber 29 is formed in the housing 2 at a position where the handle 4 is extended, and a gas bomb 30 containing combustible liquid gas is detachably contained in the bomb chamber 29. A magazine 6 loaded with the nails (not shown) is provided in a lower part of the handle 4.

A nose 7 coupled to a cylinder 20, which will be described below, and forming an injection part to be opposed to a work 28 is extended from a lower end part of the housing 2. The nose 7 guides sliding motion of a driver blade 23A, which will be described below, and the nail (not shown) to be driven into the work 28. A lower pusher 9 to be butted against the work 28 is held at an end 7A of the nose 7 so as to protrude in a direction of injecting the nail (not shown).

Figure 3:
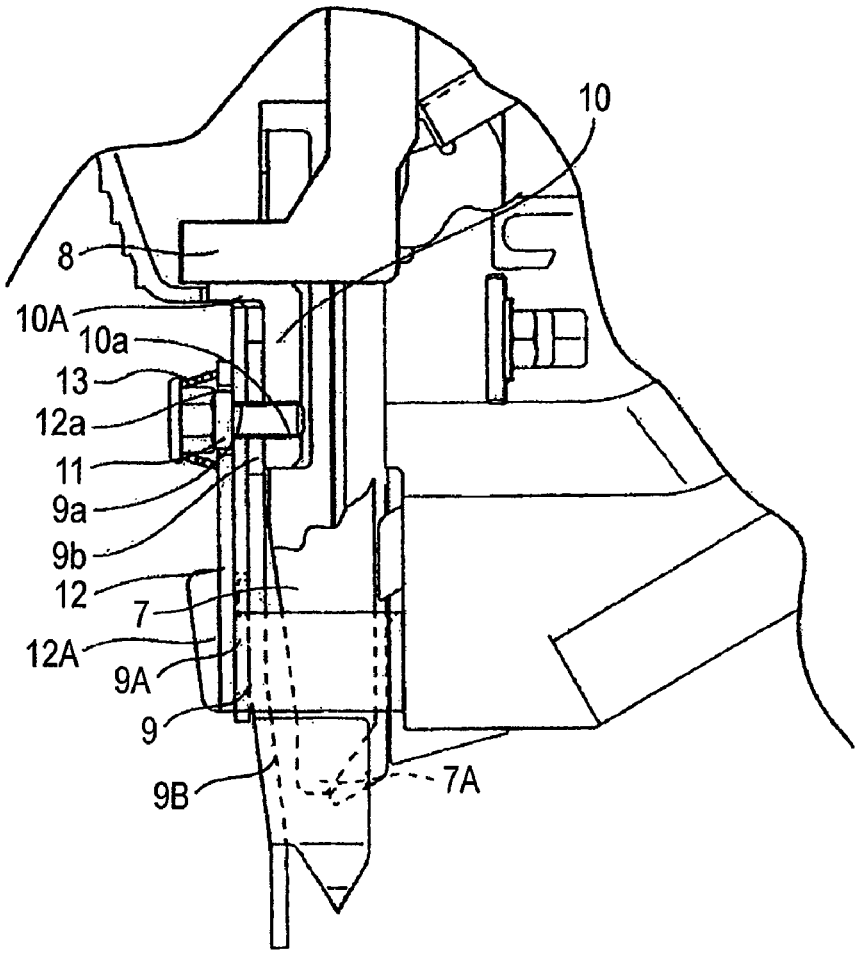
FIG. 3 is a detailed sectional view of a part including an injection part of the driving tool in the embodiment according to the invention (in a non-engaged position)

The lower pusher 9 which includes a first pusher 9A surrounding the end 7A of the nose, and a second pusher 9B extended from the end 7A is arranged so as to reciprocally slide with respect to the end 7A. Moreover, as shown in FIG. 3, the first pusher 9A is formed with a hole 9*a*, and the second pusher 9B is formed with an elongated hole 9*b* which extends in the injecting direction. The first pusher 9A and the second pusher 9B are arranged in such a manner that the hole 9*a* and the elongated hole 9*b* may be overlapped, and the second pusher 9B may come into contact with a bush 10 which will be described below.

As shown in FIG. 1, an upper pusher 8 which is fixed to a combustion chamber frame 14, which will be described below, is disposed in a cylinder 20 which is located above the lower pusher 9. A spring (not shown) is interposed between the upper pusher 8 and the cylinder 20. Consequently, the upper pusher 6 is urged downward with respect to the cylinder 20.

As shown in FIGS. 1 and 3, the bush 10 and a bolt 11 are interposed between the upper pusher 8 and the lower pusher 9. As shown in FIG. 3, the bush 10 is bent in a substantially L-shape, and a contact part 10A to be brought into contact with the upper pusher 8 is defined in a part which is bent and extended in a direction perpendicular to the injecting direction. Moreover, the bush 10 is formed with a threaded hole 10*a* into which the bolt 11 can be screwed, in a substantially center part thereof in the injecting direction.

Figure 4:
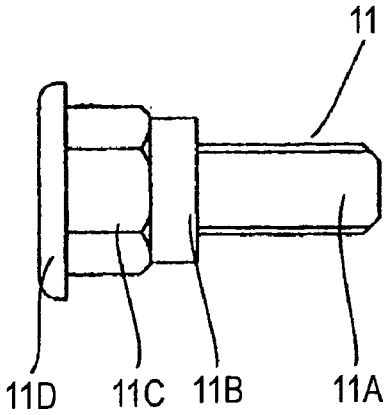
FIG. 4 is a side view of a screwing part of the driving tool in the embodiment according to the invention.

As shown in FIG. 4, the bolt 11 has a threaded part 11A, a contact part 11B, an engaging part 11C, and a flange part 11D. The threaded part 11A is arranged at a tip end of the bolt 11 and so constructed as to be screwed into the threaded hole 10*a*.

The contact part 11B is arranged adjacent to the threaded part 11A, and so constructed that a substantially round shape is formed in a sectional plane perpendicular to a longitudinal direction of the bolt 11. A diameter of the round shape in the contact part 11B is larger than the hole 9*a* (See FIG. 3). In case where the bolt 11 is screwed into the threaded hole 10*a* after passing through the hole 9*a* and the elongated hole 9*b*, the lower pusher 9 can be clamped between the contact part 11B and the bush 10 by spirally forwarding the bolt 11, whereby the lower pusher 9 can be integrally fixed to the bush 10. Consequently, when the lower pusher 9 has come into contact with the wood 28, the upper pusher 8 is urged by the bush 10 which is fixed to the lower pusher 9, and can move upward.

The engaging part 11C is arranged adjacent to the contact part 11B, and so constructed that a substantially hexagonal shape is formed in a sectional plane perpendicular to the longitudinal direction of the bolt 11. A diameter of the engaging part 11C is larger than the diameter of the contact part 11B. The flange part 11D is positioned adjacent to the engaging part 11C, at a backward end of the bolt 11.

As shown in FIG. 3, a lever 12 and a spring 13 are interposed between the bolt 11 and the bush 10. The lever 12 is provided with a grip 12A which can be grasped, and formed with a hole 12*a* which has a substantially hexagonal shape and can be engaged with the engaging part 11C. The bolt 11 is inserted into the elongated hole 9*b*, after passing through the hole 12*a*, to be screwed into the threaded hole 10*a*. These bolt 11 and lever 12 constitute a screwing part, and this screwing part and the bush 10 constitute an extending-contracting mechanism.

The spring 13 is interposed between the flange part 11D and the lever 12. Therefore, the lever 12 is urged by the spring 13 in a direction toward the distal end of the bolt 11, that is, toward the lower pusher 9. Consequently, the contact part 11B is positioned in the hole 12*a*, and the engaging part 11C will be never positioned in the hole 12*a*, unless the lever 12 is lifted against urging force of the spring 13. This position is defined as a non-engaged position of the lever 12, while the position where the engaging part 11C is engaged with the hole 12*a* is defined as an engaged position. Because the contact part 11B has a substantially round shape in section, the contact part 11B will never rotate together with the lever 12. Even though the lever 12 is rotated in a state as shown in FIG. 3, the bolt 11 is restrained from rotating together.

A head cap 15 for covering an opening at an upper end of the housing 2 is fixed to the upper end of the housing 2. As shown in FIG. 1, a motor 18 carried by a buffer member 17 is positioned in the head cap 15 at the opposite side to a combustion chamber 26, which will be described below, and an ignition plug (not shown) opposed to the combustion chamber 26 is provided near the motor 18.

In addition, the head switch (not shown) for detecting that the below described combustion chamber frame 14 is positioned at an upper end of stroke is provided in the housing 2. When the combustion type nail driving machine 1 has been pressed to the work 28 by the lower pusher 9, and the upper pusher 8 has moved upward up to a determined position, this head switch is tuned on thereby to start rotation of the motor 18.

A fuel passage 25 is formed in the head cap 15 at a side adjacent to the handle 4. The fuel passage 25 opens to a lower end face of the head cap 15 at its one end, and a gas bomb connecting part 25A to be connected to the gas bomb 30 is formed at the other end thereof.

The combustion chamber frame 14 which is movable in the longitudinal direction of the housing 2, whereby an upper end of the combustion chamber frame 14 can be brought into contact with the lower end face of the head cap 15 is provided in the housing 2. This combustion chamber frame 14 moves along with the movement of the upper pusher 8, because the upper pusher 8 is coupled and fixed to the combustion chamber frame 14. The cylinder 20 which is in contact with an inner peripheral face of the combustion chamber frame 14 to guide the movement of the combustion chamber frame 14 is fixed to the housing 2. The cylinder 20 is formed with an exhaust hole 21 at a center part in an axial direction thereof. This exhaust hole 21 is provided with a check valve (not shown) so as to selectively close the exhaust hole.

As shown in FIG. 1, a piston 23 which is reciprocally movable with respect to the cylinder 20 is provided in the cylinder 20. The piston 23 defines an upper chamber of the piston 23 and a lower chamber of the piston 23 inside the cylinder 20. The driver blade 23A is extended from a lower face of the piston 23 up to a position of the nose 7, and a tip end of this driver blade 23A becomes a position for striking the nail (not shown). Moreover, a bumper 24 formed of elastic material is arranged at a lower face of the cylinder 20. Consequently, when the piston 23 has moved downward, the piston 23 strikes the bumper 24 at its lower dead center.

When the upper end of the combustion chamber frame 14 has come into contact with the head cap 15, a combustion chamber 26 is defined by the head cap 15, the combustion chamber frame 14, and the upper chamber of the piston 23. When the combustion chamber frame 14 is separated from the head chap 15, a first flow passage communicated with an outside air is formed between the head cap 15 and the upper end of the combustion chamber frame 14, and a second flow passage continued from the first flow passage is formed between the upper end of the combustion chamber frame 14 and the upper end of the cylinder 20. Combustion gas and fresh air pass through these flow passages to flow around an outer peripheral face of the cylinder 20, and the combustion gas and so on which have passed are exhausted from the exhaust port 2*a* of the housing 2. The above described suction port is formed for the purpose of supplying air into the combustion chamber 26, and the combustion gas in the combustion chamber 26 is exhausted from the exhaust hole 21.

Fans 19 are provided in the combustion chamber 26. The fans 19 have three functions, as follows. When the combustion chamber frame 14 is in contact with the head cap 15, the fans 19 rotate thereby to stir the air and the combustible gas to be mixed. After ignition, the fans 19 generate turbulent flow combustion thereby to accelerate the combustion. When the combustion chamber frame 14 is separated from the head cap 15, and the first flow passage and the second flow passage are formed, the fans 19 exhaust the combustion gas in the combustion chamber 26, and at the same time, cools down the cylinder 20.

Figure 5:
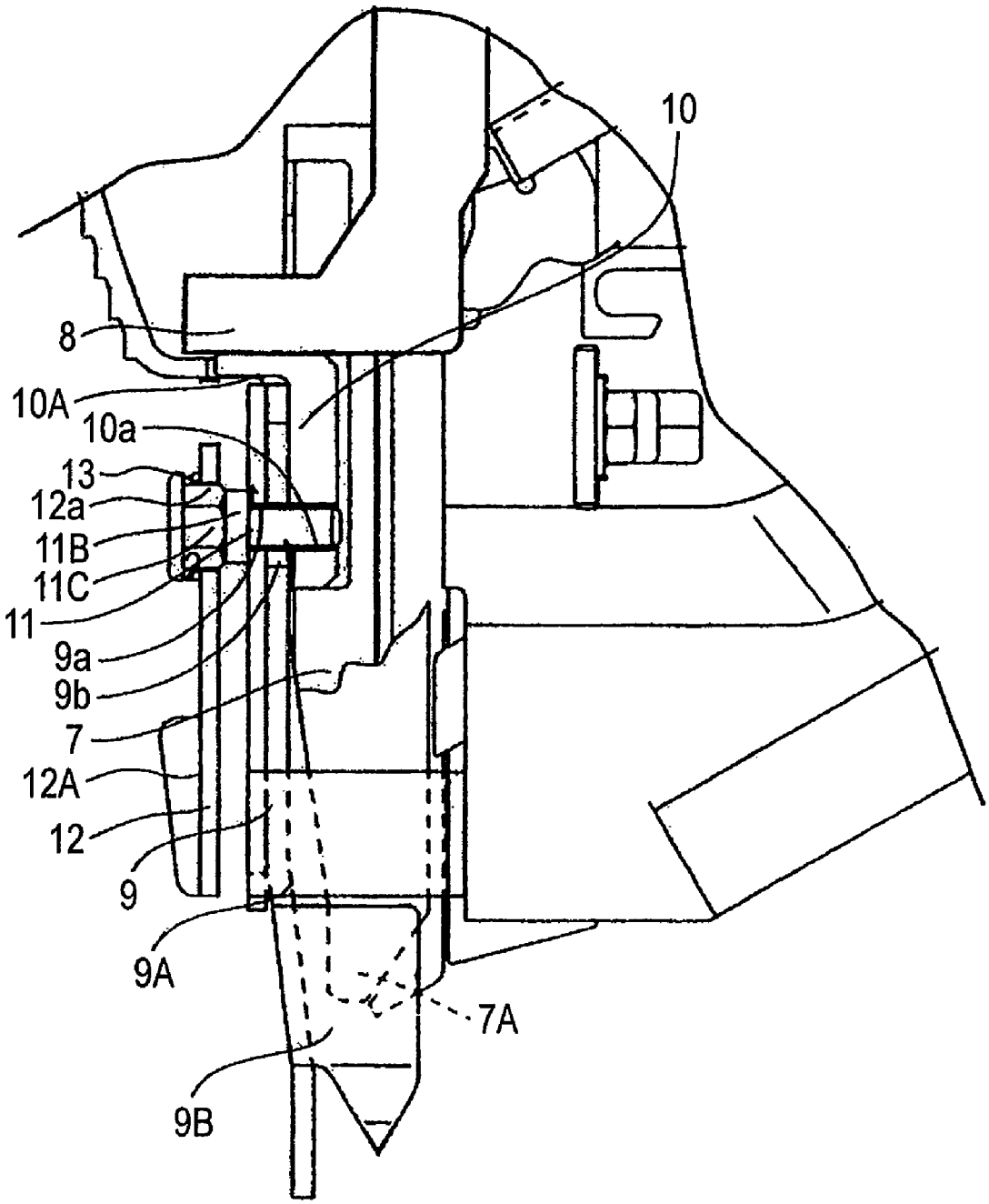
FIG. 5 is a detailed sectional view of the part including the injection part of the driving tool in the embodiment according to the invention (in an engaged position)

In the combustion type nail driving machine 1, a distance from the lower pusher 9 to the nose 7 on occasion of driving the nail is changed depending on hardness and thickness of the wood 28. In order to change a projecting amount of the lower pusher 9 from the nose 7, the lever 12 is moved to the engaged position against the urging force of the spring 13, as shown in FIG. 5, thereby allowing the engaging part 11C to be engaged with the hole 12*a*.

Figure 6:
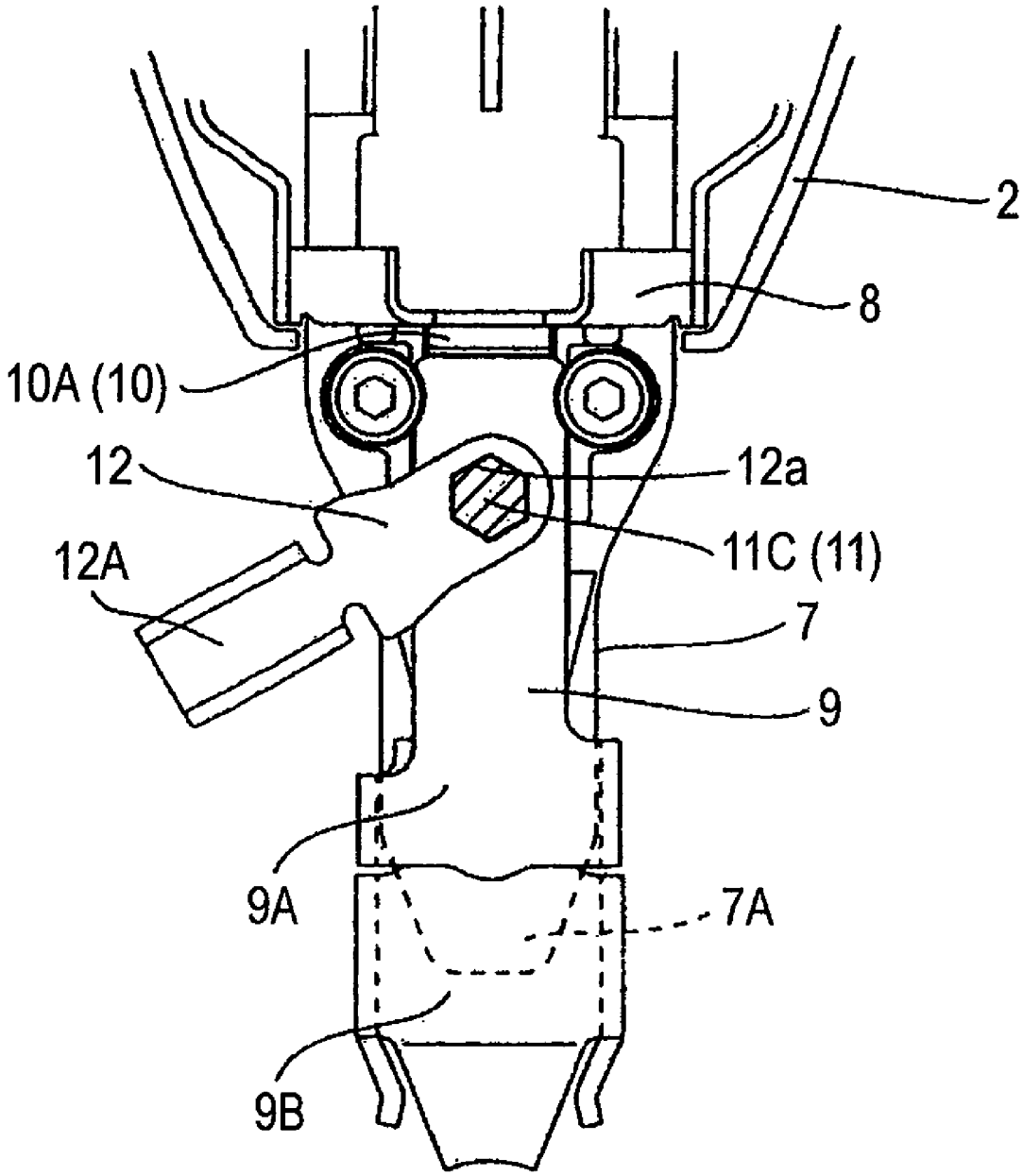
FIG. 6 is a sectional view of the upper face part including the injection part of the driving tool in the embodiment according to the invention (in a state where a grasping part has been rotated)

Because both the hole 12*a* and the engaging part 11C have a hexagonal shape, as shown in FIG. 6, the lever 12 and the bolt 11 can be rotated together. Therefore, the lever 12 is rotated by the grip 12A, thereby to rotate the bolt 11 so as to spirally retreat. As the results, the lower pusher 9 is separated from the bush 10, and the second pusher 9B can slide with respect to the bush 10 and the first pusher 9A in the injecting direction.

Figure 2:
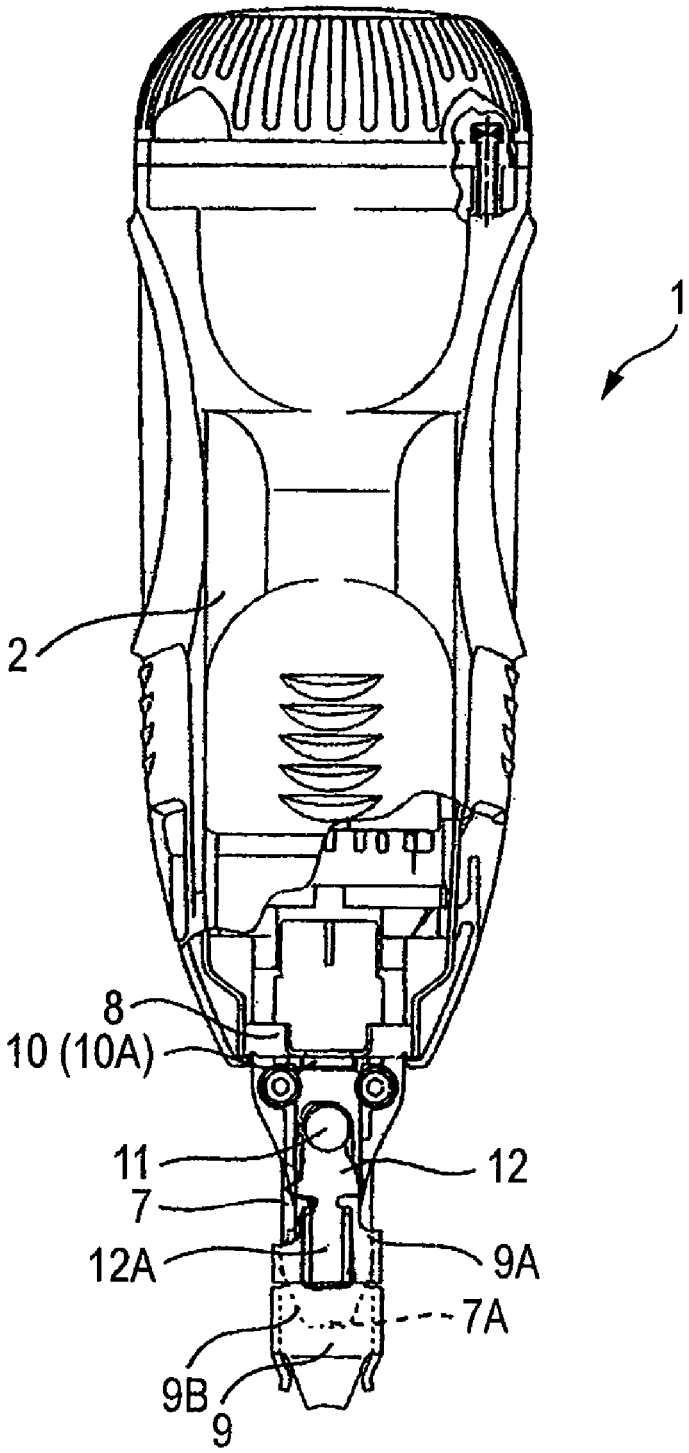
FIG. 2 is a sectional view of an upper face part of the driving tool in the embodiment according to the invention.
Figure 7:
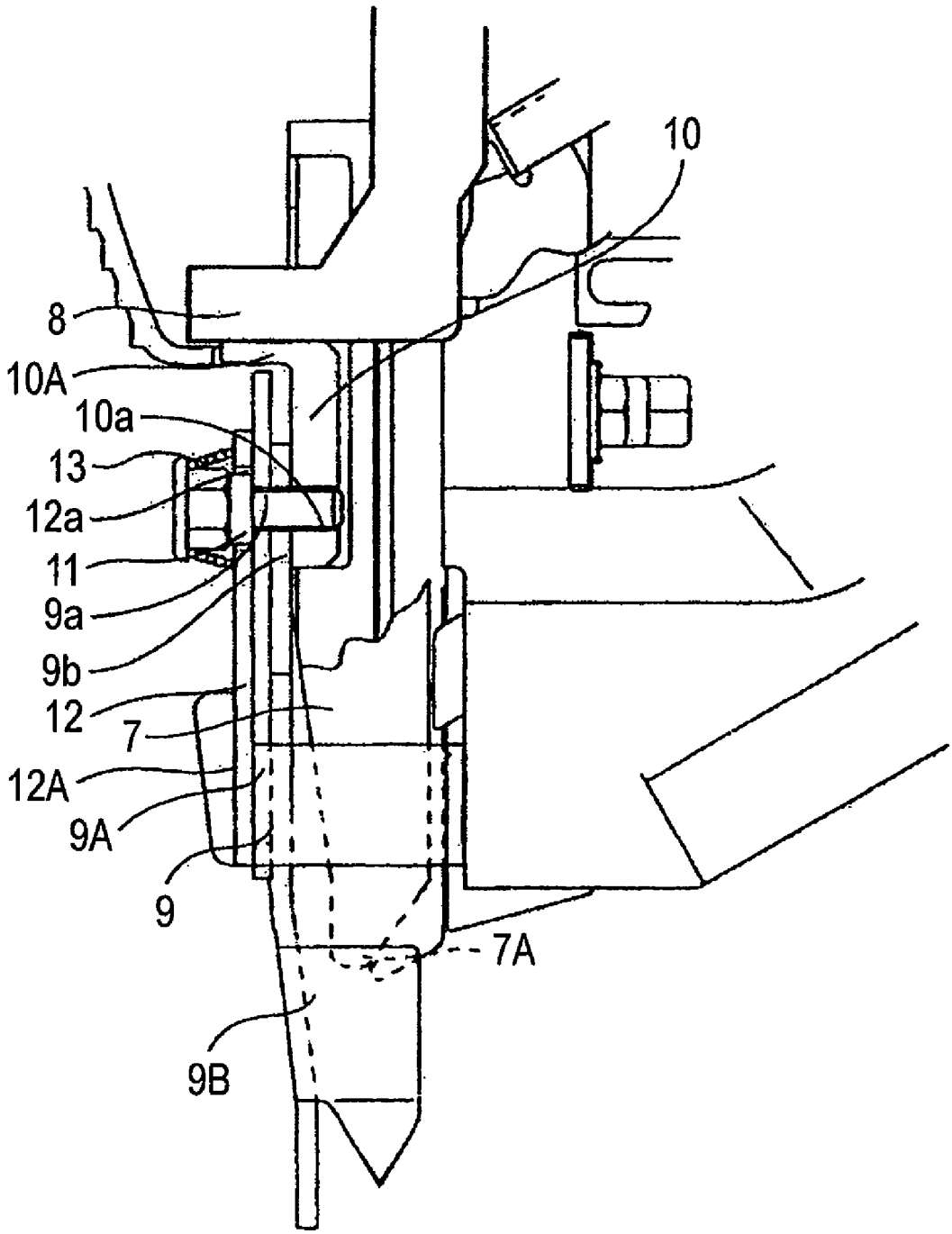
FIG. 7 is a sectional side view of the part including the injection part of the driving tool in the embodiment according to the invention (in a state where a lower pusher is extended)

After the second pusher 9B has slid with respect to the bush 10 and the first pusher 9A in the injecting direction, and the lower pusher 9 has been positioned at the determined position, as shown in FIG. 7, the lever 12 is rotated to spirally advance the bolt 11, whereby the first pusher 9A and the second pusher 9B is fixed to the bush 10. Thereafter, by releasing a hand from the lever 12, the lever 12 moves to the non-engaged position by the urging force of the spring 13. In a state where the lever 12 is in the non-engaged position, the lever 12 and the bolt 11 will not be rotated together. Therefore, even though the lever 12 is rotated in this state, the bolt 11 will not be slackened, but can always keep the lower pusher 9 and bush 10 in a fixed state. Then, by arranging the grip 12A along the injecting direction, as shown in FIG. 2, adjustment of the projecting amount of the lower pusher 9 from the nose 7 is completed.

Figure 8:
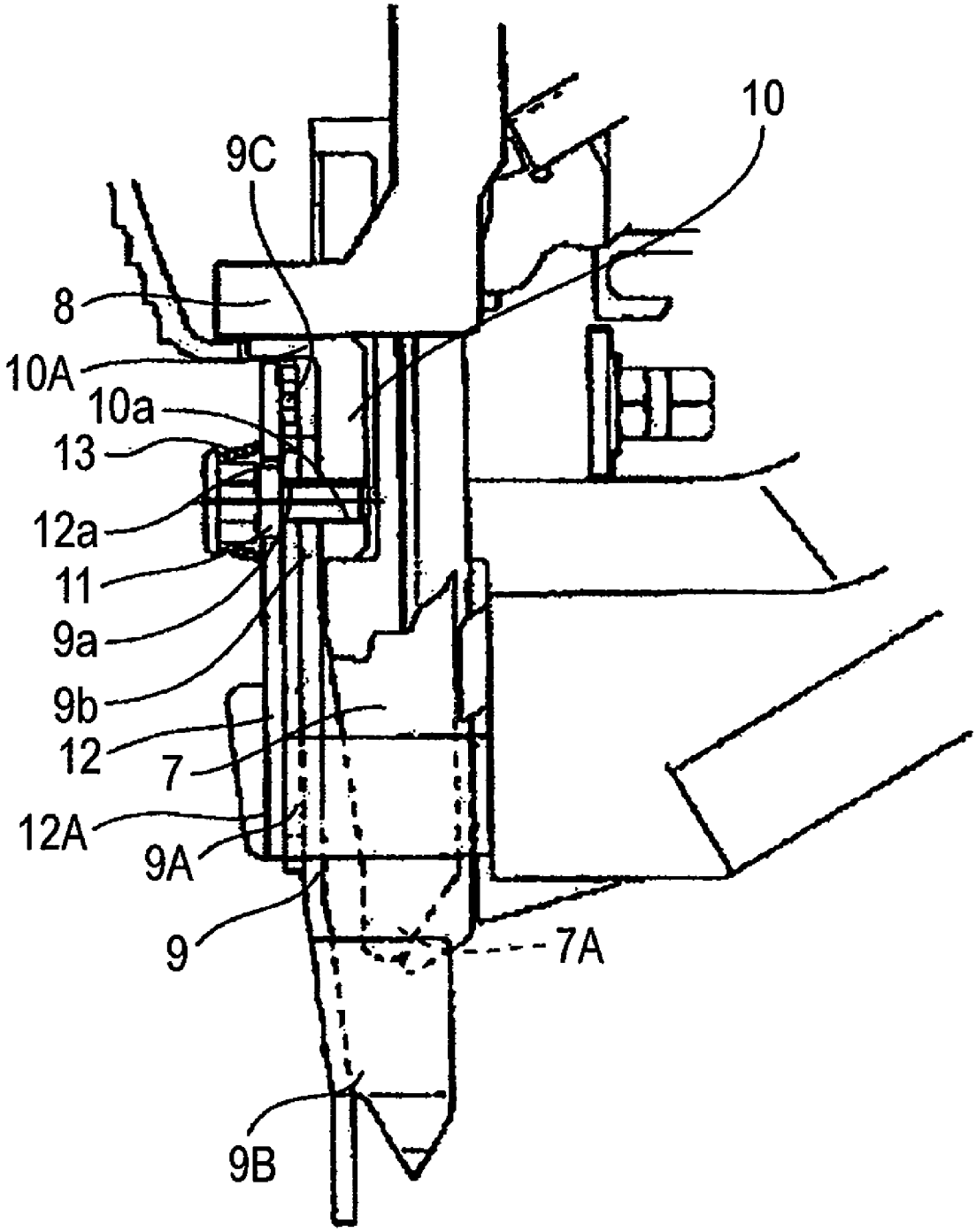
FIG. 8 is a sectional view of the part including the injection part of the driving tool in a modified case of the embodiment according to the invention.

The driving tool according to the invention is not limited to the above described embodiment, but various modifications and improvements can be made in a scope as described in the claims. For example, a scale 9C may be formed on the first pusher 9A at a position superposed on the second pusher 9B, as shown in FIG. 8. In this manner, a moving amount of the second pusher 9B with respect to the first pusher 9A can be made clear, and it is possible to easily apprehend the projecting amount of the lower pusher 9 from the nose 7.

Although the structure including the lever is employed in the grasping part, in the above described embodiment, the invention is not limited to this, but a structure including a member in a shape of a door knob may be employed. In this case too, it would be sufficient that the member can move between the non-engaged position and the engaged position with respect to the screwing part, and is kept in the non-engaged position in the ordinary state.

The invention can be applied to a driving tool for driving fastening pieces such as nails, staples and so on, by using gas, air, a motor etc. as motive power.

What is claimed is:

1. A driving tool comprising:

an injection part defining a passage for a fastening piece;

a lower pusher being provided in the injection part and extending in a longitudinal direction so as to be brought into contact with an object to be worked, the lower pusher having an elongated hole extending in the longitudinal direction;

an upper pusher adapted to slide in the longitudinal direction in association with the lower pusher;

a fixing part being in contact with the upper pusher and formed with a threaded hole;

a bolt having a threaded part, a contact part, an engaging part and a flange part, the bolt being disposed to pass through the elongated hole of the lower pusher and to be screwed into the threaded hole of the fixing part so that the lower pusher is tightly connected with the fixing part; and a lever having a hole through which the bolt is passed, the lever being disposed between the flange part of the bolt and the fixing part and movable between a first position and a second position, wherein when the lever is at the first position, the hole of the lever is engaged with the engaging part of the bolt so that the bolt is rotated with the lever and when the lever is at the second position, the hole of the lever is positioned at the contact part of the bolt so that the bolt is not rotated with the lever, wherein the bolt is released from the fixing part by rotating the lever at the first position and the lower pusher is moved in the longitudinal direction in the elongated hole, and wherein a spring is interposed between the flange part of the bolt and the lever so that the lever is biased to take the second position.

2. A driving tool as claimed in claim 1, wherein the lever rotates the threaded part, and wherein the lever which is engaged with the engaging part is rotated to release connection between the lower pusher and the fixing part, thereby permitting the lower pusher to move.

* * * * *